United States Patent [19]

Carson

[11] Patent Number: 4,944,721

[45] Date of Patent: Jul. 31, 1990

[54] CAVITY SEALING SYSTEM FOR A CENTRIFUGE ROTOR

[75] Inventor: David M. Carson, Newtown, Conn.

[73] Assignee: E. I. Du Pont de Nemours and Company, Wilmington, Del.

[21] Appl. No.: 278,561

[22] Filed: Nov. 9, 1988

[51] Int. Cl.[5] ..... B04B 1/00; B04B 7/02

[52] U.S. Cl. ..... 494/16; 494/85

[58] Field of Search ..... 494/16, 17, 18, 19, 494/21, 38, 85; 422/72, 99, 102

[56] References Cited

U.S. PATENT DOCUMENTS

| | | | |
|---|---|---|---|
| 2,827,229 | 3/1958 | Blum | 494/16 |
| 3,133,882 | 5/1964 | Mitchell et al. | 494/16 |
| 3,447,712 | 6/1969 | Galasso et al. | 220/24.5 |
| 3,459,369 | 8/1969 | Marks . | |
| 3,635,370 | 1/1972 | Romanauskas | 220/46 |
| 3,819,111 | 6/1974 | Romanauskas et al. . | |
| 3,901,434 | 8/1975 | Wright . | |
| 3,998,383 | 12/1976 | Romanauskas et al. . | |
| 4,010,890 | 3/1977 | Wright . | |
| 4,076,170 | 2/1978 | Chulay et al. . | |
| 4,080,175 | 3/1978 | Chulay et al. . | |
| 4,087,043 | 5/1978 | Anderson et al. . | |
| 4,102,490 | 7/1978 | Chulay et al. . | |
| 4,114,803 | 9/1978 | Romanauskas . | |
| 4,166,573 | 9/1979 | Webster . | |
| 4,190,196 | 2/1980 | Larsen . | |
| 4,202,487 | 5/1980 | Edwards . | |
| 4,222,513 | 9/1980 | Webster et al. . | |
| 4,235,367 | 11/1980 | Davidson . | |
| 4,285,904 | 8/1981 | Ishimaru et al. | 264/322 |
| 4,290,550 | 9/1981 | Chulay et al. . | |
| 4,301,963 | 11/1981 | Neilsen . | |
| 4,304,356 | 12/1981 | Chulay et al. . | |
| 4,306,676 | 12/1981 | Edwards et al. | 494/16 |
| 4,342,419 | 8/1982 | Conway . | |
| 4,360,151 | 11/1982 | Cowell et al. . | |
| 4,372,483 | 2/1983 | Wright | 494/38 X |
| 4,412,830 | 11/1983 | Strain et al. | 494/12 |
| 4,537,320 | 8/1985 | Neilsen | 215/276 |
| 4,552,278 | 11/1985 | Romanauskas | 215/277 |
| 4,568,325 | 2/1986 | Cheng et al. | 494/84 |
| 4,690,670 | 9/1987 | Nielsen | 494/16 |

*Primary Examiner*—Harvey C. Hornsby
*Assistant Examiner*—Scott J. Haugland

[57] ABSTRACT

A centrifuge rotor includes a structural member having a plurality of receptacles therein. When the covert is attached to the body of the rotor the receptacles communicate with a respective one of the cavities disposed in the body of the rotor.

16 Claims, 8 Drawing Sheets

CAVITY SEALING SYSTEM FOR A CENTRIFUGE ROTOR

FIELD OF THE INVENTION

The present invention relates to a centrifuge rotor having tube receiving cavities therein, and in particular, to a cavity sealing system which retains individual sample containers within their individual cavities.

DESCRIPTION OF THE PRIOR ART

Vertical tube centrifuge rotors are well known. Such rotors are so named because the axes of the sample container receiving cavities formed in the rotor body lie parallel to the axis of rotation of the rotor. Exemplary of such a rotor is that shown in U.S. Pat. No. 3,998,383 (Romanauskas et al.), assigned to the assignee of the present invention.

When using such rotors each of the sample containers must be individually capped or sealed to contain the liquid therewithin during centrifugation. Moreover, each of the containers must be constrained within its respective cavity. Various container capping, sealing and constraining arrangements for containers used in vertical rotors are known in the art. Exemplary of such devices are those shown in U.S. Pat. No. 4,222,513 (Webster et al.), U.S. Pat. No. 4,166,573 (Webster), U.S. Pat. Nos. 4,114,803; 3,635,370 and 4,552,278 (all to Romanauskas), U.S. Pat. No. 4,190,196 (Larsen,) U.S. Pat. No. 4,285,904 (Ishimaru et al.), U.S. Pat. No. 3,459,369 (Marks) and U.S. Pat. No. 3,447,712 (Galasso et al.)

In the typical case the constraining arrangements are plug-like members that are threadedly engaged to threads formed in the body of the rotor adjacent to the mouth of each cavity. As such the plugs must be tightened to certain torque specifications to insure that they will perform their constraining function. However, verifying that these torque specifications are met is a time-consuming, labor-intensive operation. In addition, the provision of the threads in the rotor body imparts certain stresses thereto. Exemplary of such devices are those shown in U.S. Pat. Nos. 4,301,963 and 4,690,670 (both to Nielsen), U.S. Pat. Nos. 4,076,140; 4,080,175; 4,102,490 and 4,290,550 (all to Chulay et al.), U.S. Pat. No. 4,087,043 (Anderson et al.), U.S. Pat. No. 4,235,367 (Davidson), and U.S. Pat. No. 4,568,325 (Cheng et al.).

U.S. Pat. No. 4,304,356 (Chulay et al.) discloses a cap that, once inserted into the cavity, "floats" on the tube disposed in the cavity. That is to say, the cap does not threadedly engage with any threads in the rotor body. It is believed that the device described in this patent is not adapted for use in a vertical tube rotor.

In veiw of the foregoing it is believed advantageous to provide a rotor in which the necessity for individual constraining arrangements for the sample containers is eliminated.

SUMMARY OF THE INVENTION

The present invention relates to a cavity sealing system for a centrifuge rotor of the vertical type having a body with plural cavities therein. Each cavity is sized to receive a sample container. The upper portion of the sample container exhibits a predetermined configuration. The rotor includes a cover. The sealing system is characterized by a structure on the rotor having an array of receptacles formed therein. Each of the receptacles is shaped in correspondence to the configuration of the upper portion of the container. The structure having the receptacle therein is mounted to the rotor body to close the cavity, thereby sealing the same. When so mounted each of the receptacles communicates with a cavity, with the upper surface of the container being received within the receptacle.

In one embodiment of the invention the structure having the receptacles therein is integrally formed in the cover. In one form the cover has a continuous annular ring thereon in which the receptacles are formed. The ring extends a predetermined distance above the upper surface of the cover and the receptacles open from the lower surface thereof. In an alternate form the cover has an annular array of discrete, angularly spaced bosses on the upper surface thereof. Each of the bosses extends a predetermined distance above the upper surface of the cover. Each boss has a receptacle formed therein.

The ring or individual bosses, as the case may be, define a central region on the cover. The central region has a center of mass associated therewith that is located in a predetermined plane. The ring or bosses also have a center or mass associated therewith, with the center(s) of mass of the ring or bosses, respectively, being spaced above the plane containing the center of mass of the central region of the cover. As a result of such an arrangement, as the rotor is spun, the mass of the ring or of each of the bosses responds to centrifugal force to generate a moment which acts on the cover. This moment serves as a constraining force acting on the containers to assist in holding the same in their respective cavities.

In an alternate embodiment a series of individual tube restraining inserts are provided. Each insert has a receptacle therein. The inserts are insertable into the cavities. In one arrangement the upper surface of the insert is flush with the upper surface of the rotor body. In this case the lower surface of the cover overlies the surface of the rotor and abuts the upper surface of the inserts. In another arrangement the upper surface of the insert extends above the surface of the rotor and project into an annular groove formed on the undersurface of the cover. In still another arrangement the upper surface of the insert is retained within the cavity. In this case the undersurface of the cover has downwardly depending pegs thereon, which project into the cavity to abut the upper surface of the inserts. The cover is additionally provided with either the annular ring or the array of upwardly extending bosses thereon. When the cover is attached to the rotor, the constraining force generated by the moment holds each insert within its cavity.

Means for angularly locating the cover with respect to the body of the rotor is provided. In the preferred case the locating means takes the form of a member, such as a tab or a pin, that projects from the cover into a corresponding aperture provided in the rotor body. When the projecting member is received in the aperture, the angular position of the cover with respect to the body is defined. The projecting member may extend from either surface of the cover or from the rim thereof.

BRIEF DESCRIPTION OF THE DRAWINGS

The invention will be more fully understood from the following detailed description thereof, taken in connection with the accompanying drawings, which form a part of this application and in which.

DETAILED DESCRIPTION OF THE INVENTION

Figure 1:
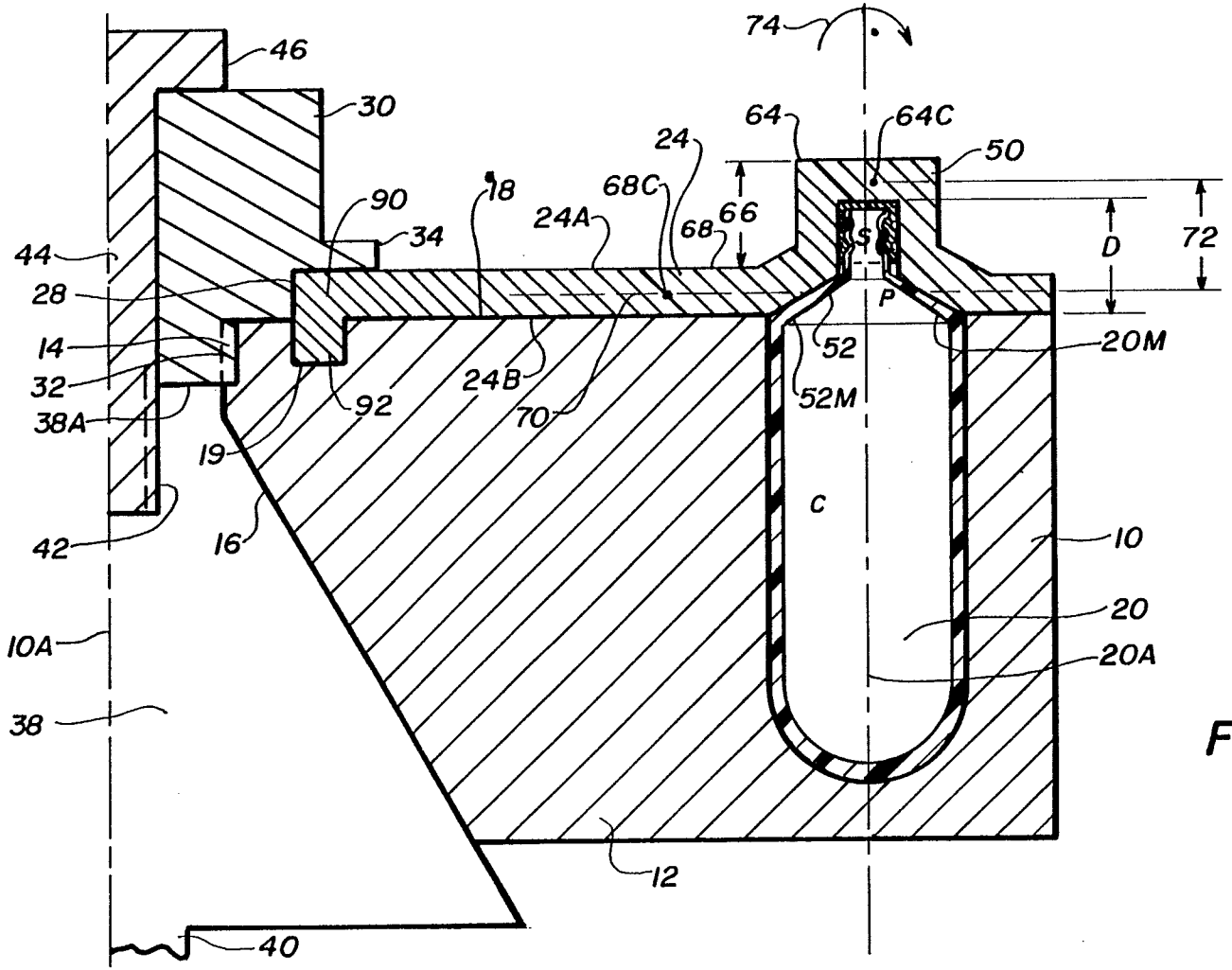
FIG. 1 is a side elevational view, entirely in section, of a cavity sealing system for a centrifuge rotor in accordance with a first embodiment of the present invention in which the cover of the rotor is provided with integral receptacles and in which each receptacle lies above and in communication with a cavity in the rotor.

Throughout the following detailed description similar reference characters refer to similar elements in all figures of the drawings.

A portion of FIG. 1 shows a side elevational view of a rotor generally indicated by reference character 10 with which either embodiment of the cavity sealing system of the present invention may be used. The rotor 10 includes a body portion 12 that is typically integrally fabricated from a suitable material, such as titanium, aluminum or a composite. The body portion 12 has a threaded opening 14 arranged centrally and axially therein. A mounting recess 16 extends into the rotor body 12 from the undersurface thereof and communicates with the threaded opening 14. The upper surface of the rotor body portion 12 defines a reference surface 18. An aperture 19 is provided in the body portion 12 of the rotor 10 for a purpose to be made clear herein. A plurality of sample container receiving cavities 20 is arranged in an annular array in the body 12. Each cavity 20 has an open mouth 20M. The axis 20A of each of the cavities 20 is parallel to the vertical axis of rotation 10A of the rotor 10. The rotor 10 is thus referred to as a vertical rotor.

Figure 3:
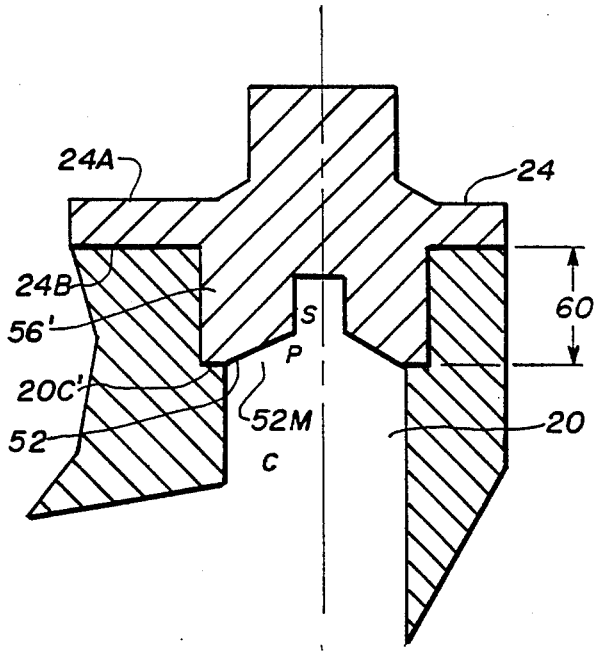

Each of the cavities 20 is sized to received a sample container C therein. Each container C is closed by a suitable cap or seal S, as should be appreciated by those skilled in the art. The uppermost portion P of the container C, in which the seal S is disposed, has a predetermined configuration associated therewith. This portion P of the container C may project a predetermined distance D above the reference surface 18, as shown in FIG. 1, or, as shown in FIG. 3, the entirety of the container C, including the portion P thereof, may be totally confined within the cavity 20.

A cover generally indicated by reference character 24 is disposed in overlaying relationship to the rotor body 12. The cover 24 is a generally annular disc-like member fabricated from materials similar to those used for the rotor body 12. The cover 24 has an upper surface 24A and a lower surface 24B and a central axial opening 28 that extends therethrough. The opening 28 receives the threaded shank 32 of a cover nut 30. The shank 32 threadedly engages the aperture 14 in the rotor body 12. When so secured an annular hold down flange 34 on the cover nut 30 engages against the upper surface 24A of the cover 24. It should also be understood that the cover 24 may be of the type that has a threaded engagement boss depending from the lower surface 24B thereof in order to attach the cover to the rotor body 12.

A mounting adapter 38 attached to the upper end of a drive spindle 40 is received within the mounting recess 16. The adapter 38 has a threaded bore 42 extending centrally and axially through a portion thereof from the upper surface 38A of the adapter 38. A threaded hold down screw 44 having an enlarged knob 46 thereon extends through the cover nut 30 and into threaded engagement with the threads in the bore 42.

The present invention relates to a cavity sealing arrangement generally indicated by the reference character 50 for closing the open mouth 20M of the cavity 20 in the rotor body. In general, the cavity sealing system 50 of the present invention includes a structural member mounted to the rotor that contains an array of receptacles that correspond in configuration to the upper portion of the container. The receptacles communicate with the cavities. When the cover is secured to the rotor the structural member cooperates with the body of the rotor to close the cavites. The receptacles accept the upper portion of the containers therein.

The invention can be implemented in either of two broad embodments. In the first embodiment, discussed in connection with FIGS. 1 through 5, the structural member having the receptacles that accept the upper surface of the containers is formed integrally with the cover of the rotor, while in a second embodiment, shown in FIGS. 7 through 11, the structural member takes the form of tube restraining inserts in which the receptacles are formed. Each insert is received in a cavity and cooperates with the cover of the rotor to close the cavity.

With reference now to FIGS. 1 through 5, various forms of the first embodiment of the sealing arrangement 50 are shown. In this embodiment the structure that has the receptacles 52 therein is integral with the cover. In one form, discussed in connection with FIG. 4, the cover has an annular ring integral therewith in which the receptacles are formed. In the form discussed in connection with FIG. 5 the structure in the cover is formed by an array of bosses, each of which is provided with a receptacle therein. In each case the number of receptacles 52 corresponds to the number of cavities 20 in the body 12. Each of the receptacles has a mouth 52M thereon. The receptacles 52 correspond in shape to the configuration of the upper portion P of the container C.

In FIG. 1 the upper portion P of the container C is shown to project above the reference surface 18. When the cover 24 is disposed on the rotor body 12 the cover 24 overlies the body 12 of the rotor 10 such that each receptacle 52 communicates with a respective corresponding cavity 20 in the body 12. As a result, with the container as shown in FIG. 1, the upper portion P of each container C is received within the receptacle 52 associated with the cavity 20 in which the container C is disposed. The combination of the body 12 and the structure of the cover 24 having the receptacle therein serves to totally surround the container C, thus obviating the need for a separate constraining mechanism for the container C.

Figure 2:
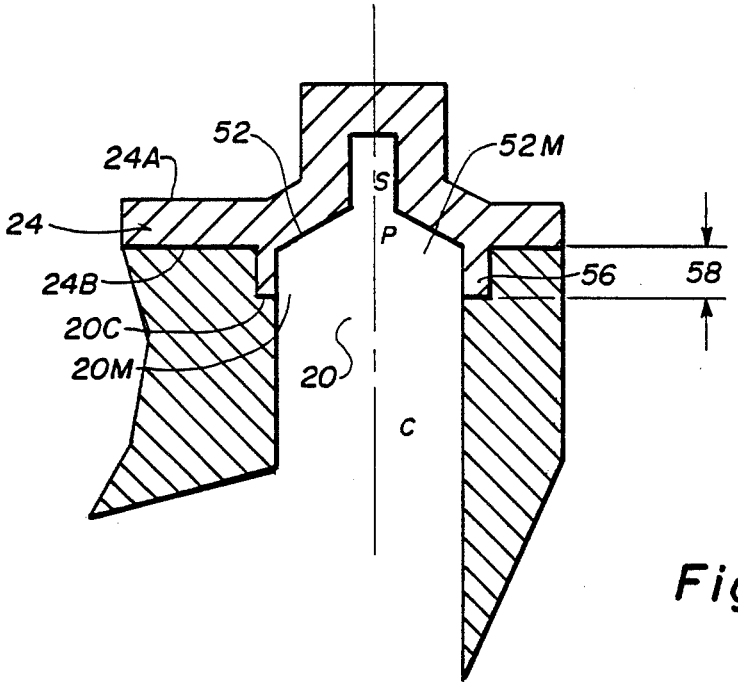
FIGS. 2 and 3 are side elevation views, in section, of a cover similar to that shown in FIG. 1 having alternate structural forms in which the receptacles are provided.

The cover 24 may, if desired and as shown in FIG. 2, have an array of annular flanges 56 depending a predetermined distance 58 from the lower surface 24B thereof. Each flange 56 is disposed in surrounding relationship with respect to the mouth 52M of an associated receptacle 52. The body 12 of the rotor 10 is modified in this instance to accept the flange 56 by providing a counterbore 20C adjacent the mouth 20M of each cavity 20. When the cover 24 is secured to the rotor body 12 the flanges 56 extend into the counterbore 20C.

It has been noted earlier that the upper portion P of the container C may be totally confined within the cavity 20, as seen in FIG. 3. In this event the depending flange may be elongated, as shown at 56'. In this arrangement the mouth 25M of the receptacle 52 opens a predetermined distance 60 below the lower surface 24B of the cover 24. The counterbore 20C' in the body 12 is correspondingly elongated.

Figure 4:
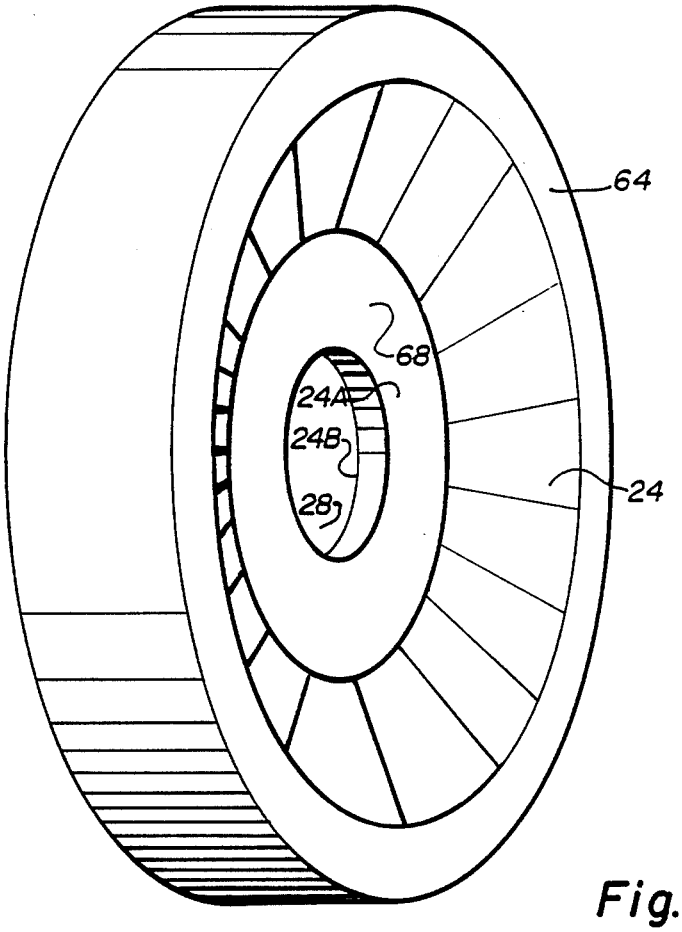
FIG. 4 is an isolated perspective view of a cover having an annular ring disposed thereon in which any form of the receptacles shown in FIGS. 1 to 3 may be provided.

As noted earlier, the structure of the cover 24 having the receptacles 52 (in any of the forms shown in FIGS. 1, 2 or 3) are provided in the cover 24 in either of two ways. As shown in FIG. 4, the cover 24 may have a continuous annular ring 64 integrally formed therewith in which the receptacles 52 are formed. The ring 64 extends for a predetermined distance 66 above the upper surface 24A of the cover 24 and bounds a central region 68 thereon. The center of mass 68C of the central region 68 is located in a predetermined reference plane 70 lying perpendicular to the axis of rotation 10A. The center of mass 64C of the ring 64 is spaced a predetermined distance 72 above the reference plane 70. The mouth 52M of each receptacle 50 opens on the lower surface 24B of the cover 24. During centrifugation, with the cover 24 on the body portion 12 of the rotor 10 the center of mass 64C of the ring 64 generates a moment acting in the direction of an arrow 74 which urges the cover 24 toward the body 12 of the rotor 10.

Figure 5:
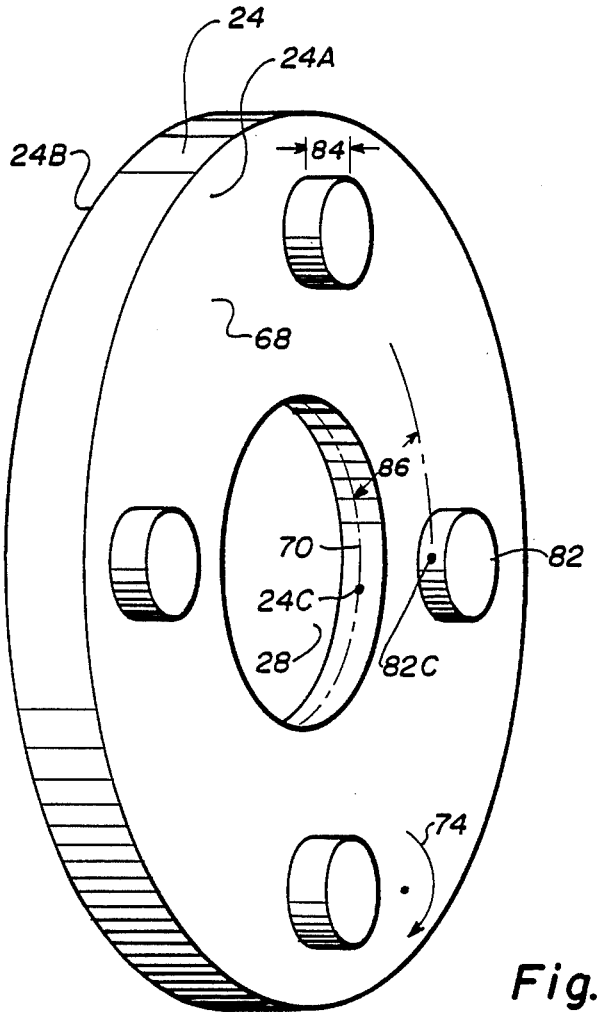
FIG. 5 is an isolated perspective view of a cover having an annular array of bosses disposed thereon, each boss being adapted to carry any form of the receptacles shown in FIGS. 1 to 3.

In an alternate configuration, shown in FIG. 5, the cover 24 has an annular array of discrete, angularly spaced bosses 82 integrally formed therewith in which the receptacles 52 are provided. Each boss 82 extends for predetermined distance 84 above the upper surface 24A of the cover 24. The distance 84 may equal the distance 66, FIG. 1, if desired. Similar to the ring 74 the array of bosses 82 bounds the central region 68 of the cover 24. The center of mass 82C of each of the bosses 82 is spaced a predetermined distance 86 above the reference plane 70 which contains the center of mass 24C of the cover 24. Similar to the situation described in connection with the arrangement of FIG. 4, because the centers of mass 82C of the bosses 82 lie above the plane of the mass center 24C of the cover, during centrifugation a moment acting in the direction an arrow 74 is generated to urge the cover 24 toward the body 12 of the rotor 10.

Either configuration of the cover shown in FIGS. 4 or 5, whether or not modified in accordance with FIGS. 2 or 3, may further include means generally indicated by reference character 90 for angularly locating the cover 24 with respect to the body 12 of the rotor 10. In the preferred case the locating means 90 takes the form of a tab 92 that projects from the lower surface 24B of the cover 24 into the corresponding aperture 19 provided in the rotor body 12. When the tab 92 is received in the aperture 19 the angular position of the cover 24 with respect to the body 12 is defined. It should be understood that any equivalent form of locating means may be used. For example, the tab may form part of the rotor and extend from the surface thereof into an opening provided in the cover.

Figure 7:
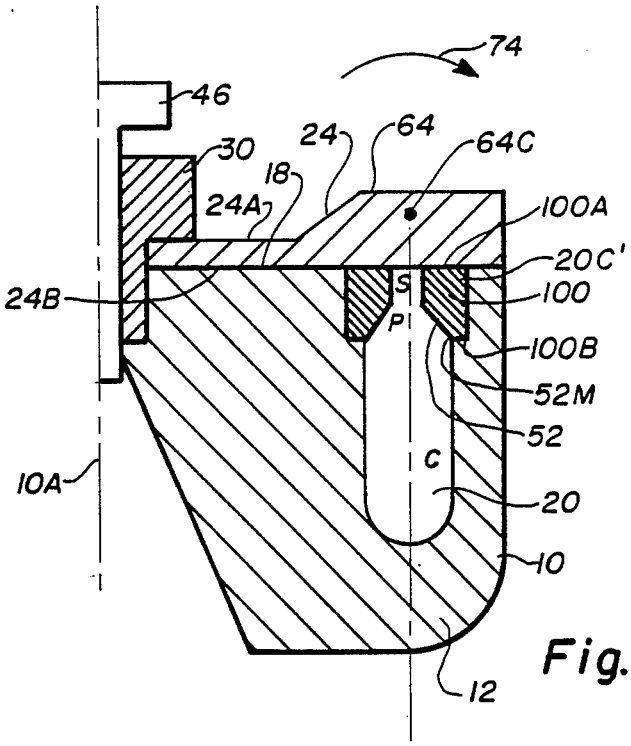
FIG. 7 is a side elevation view, entirely in section, of a cavity sealing system for a centrifuge rotor in accordance with a second embodiment of the present invention in which a tube restraining insert is received in the cavity and which cooperates with the body of the rotor to seal the cavity.
Figure 8:
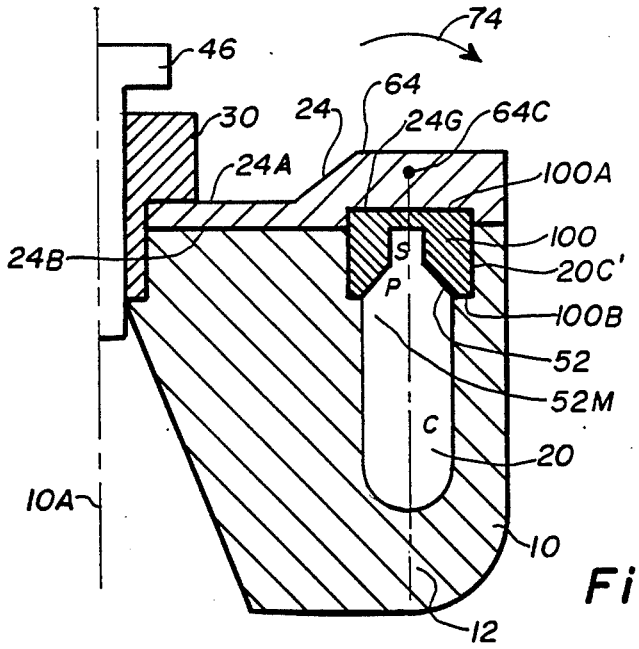
FIGS. 8 and 10 are side elevational views similar to FIG. 7 illustrating alternate arrangements of the second embodiment of the invention in which the upper surface of the inserts are respectively disposed above and below the surface of the rotor.
Figure 9:
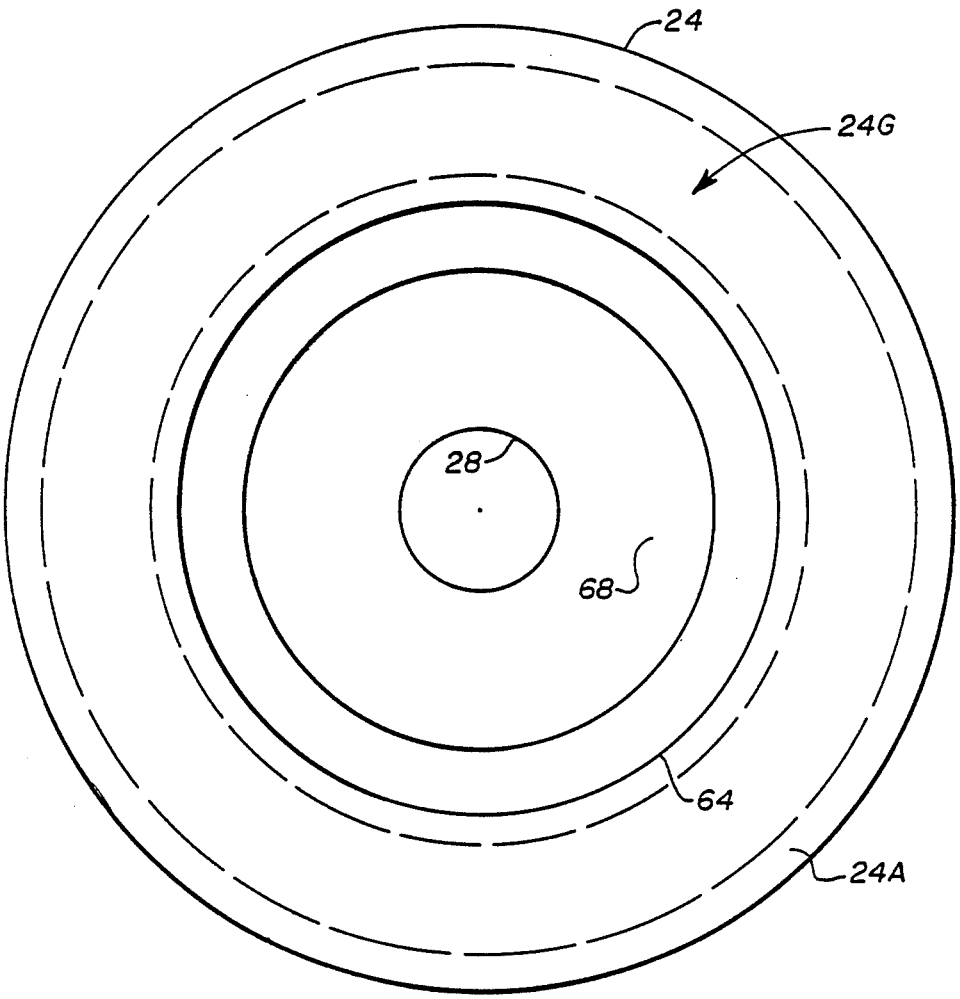
FIGS. 9 and 11 are, respectively, plan and perspective views of a rotor cover useful with the arrangements of the invention respectively shown in FIGS. 8 and 10.
Figure 10:
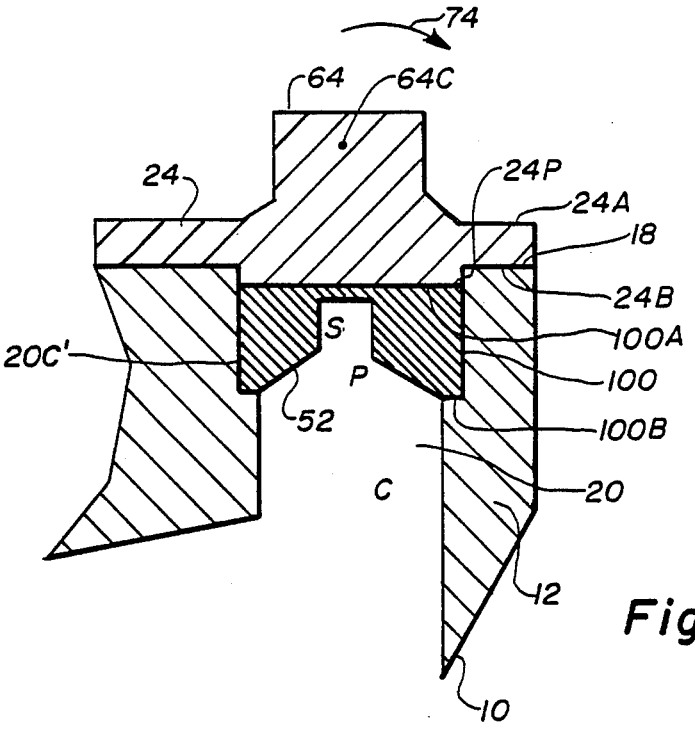
Figure 11:
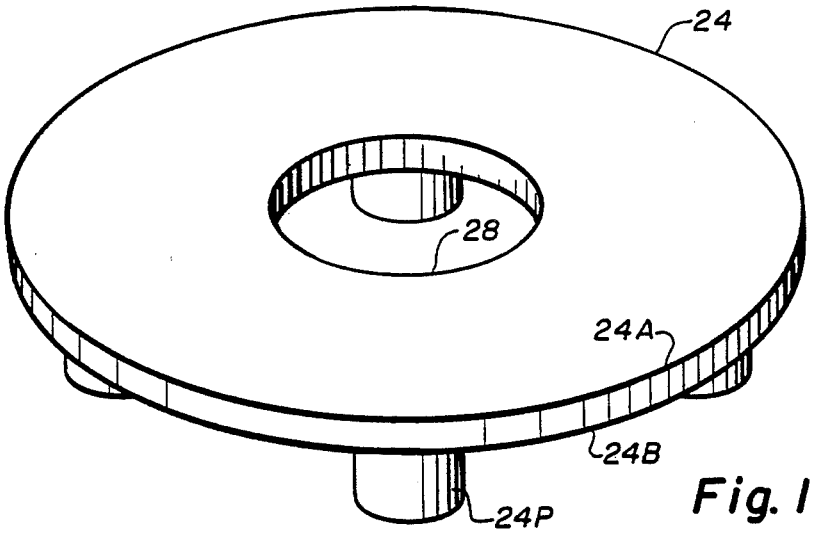

The second embodiment of the cavity sealing system 50 in accordance with the present invention is shown in FIGS. 7 through 11. In this embodiment the structure having the the receptacles 52 therein takes the form of a tube restraining insert 100. Each insert is received in the cavity 20 and is held therein by the cooperative interaction of the cover 24. The insert 100 is fabricasted from material similar to that used for the rotor body. The insert 100 has an upper surface 100A and a lower surface 100B. The receptacle is provided into the lower surface 100B of the insert 100. The upper surface 100A of the insert has a predetermined configuration thereon. In FIGS. 7, 8 and 10, the upper surface 100A is shown as generally planar, although it should be understood that such a configuration is not necessarily required.

In FIG. 7 the body 12 is modified to provide an enlarged counterbore 20C' which accepts the insert 100. The counterbore 20C' is sized such that when the insert 100 is received therein the upper surface 100A of the insert lies flush with the reference surface 18 of the rotor body 12. The undersurface 24B of the cover 24, when the same is mounted to the body of the rotor, abuts against the upper surface 100A of the insert 100. Of course, if the configuration of the upper surface 100A where other than planar, the undersurface 24B of the cover 24 that abuts the same is correspondingly modified.

In FIG. 8 the counterbore 20C' is sized such that when the insert 100 is received therein the upper surface 100A of the insert 100 projects above the reference surface 18. In this event the cover 24 is modified to exhibit an annular groove 24G on the undersurface 24B thereof. FIG. 9 is a plan view of the cover 24 illustrating the location of the groove 24G therein. In this arrangement the insert 100 projects into the groove 24G and the upper surface 100A of the insert 100 abuts against the base of the groove 24G, as seen in FIG. 8.

In FIG. 10 the counterbore 20C' is sized such that the upper surface 100A of the insert 100, when the same is received in the cavity 20, lies below the reference plane 18 of the rotor body 12. In this event, the cover 24 is provided with an array of pegs 24P, generally similar to the bosses 24B, only depending from the lower surface 24B of the cover 24. The lower surface 100A of the insert 100. The pegs 24P are sized to project into the cavity 20 to abut the upper surface 100A of the insert 100.

Whether implemented in any of the forms shown in FIGS. 7 through 11, when the cover 24 is disposed on the rotor body 12 the cover 24 overlies the body 12 of the rotor 10 and the lower surface 24B thereof abuts the upper surface 100A of the inserts 100. Moreover, each receptacle 52 in each insert 100 communicates with a respective corresponding cavity 20 in the body 12. As a result the upper portion P of each container C is received within the receptacle 52 associated with the cavity 20 in which the container C is disposed. The combination of the body 12 of the rotor and the insert 100 serves to totally surround the container C, thus obviating the need for a separate constraining mechanism for the container C.

Either form of the cover 24 shown in FIG. 4 or FIG. 5 may be used to hold the inserts 100 in place. That is, the cover 24 may be provided with the continuous annular ring 64 integrally formed therewith. During centrifugation, with the cover 24 on the body portion 12 of the rotor 10 the center of mass 64C of the ring 64 generates a moment acting in the direction of an arrow 74 which urges the cover 24 toward the body 12 of the rotor 10. This action holds the lower surface 24B of the cover 24 against the upper surfaces 100A of the inserts 100 and maintains the inserts 100 within the cavities. This holding action is generated regardless of the form of the inserts (FIGS. 7, 8 or 10).

Figure 6:
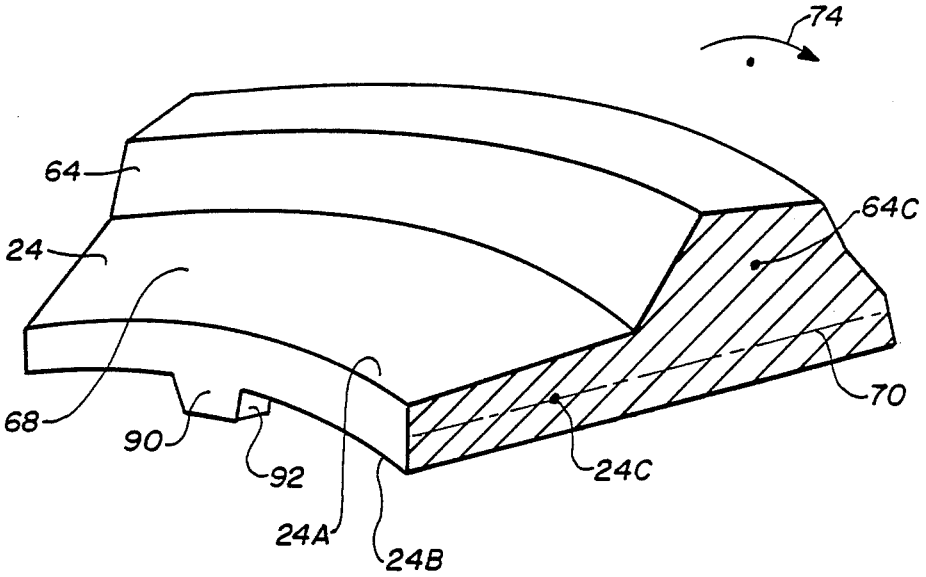
FIG. 6 is an isolated perspective view of a fragment of the embodiment of the cover shown in FIGS. 4 or 5 having a locating member disposed thereon.

Alternately, the cover 24 may have the annular array of discrete, angularly spaced bosses 82 integrally formed therewith which, during centrifugation, generate the moment acting in the direction of an arrow 74. It should also be understood that the cover may also have the locating means 90 shown in connection with FIG. 6, if desired.

Those skilled in the art, having the benefit of the teachings of the present invention may effect numerous modifications thereto. It should be understood that such modifications are to be construed as lying within the contemplation of the present invention, as defined by the appended claims.

What is claimed is:

1. A cover for a centrifuge rotor having a body with plural cavities therein, the cover having an annular ring disposed thereon, an array of receptacles being formed in the annular ring, a plurality of flanges depending a predetermined distance from the cover, each flange being disposed in surrounding relationship with one of the receptacles, the receptacles being arranged so that when the cover is attached to the body each of the receptacles communicates with one of the cavities and each flange is receivable in one of the cavities.

2. The cover of claim 1 further comprising means for locating the cover at a predetermined angular position with respect to the body of the rotor.

3. The cover of claim 1 wherein the annular ring bounds a central region of the cover, the center of mass of the central region lying in a predetermined plane, the center of mass of the annular ring being spaced from the plane containing the center of mass of the central region.

4. A cover for a centrifuge rotor having a body with plural cavities therein, the cover having a plurality of bosses disposed thereon, each boss having a receptacle formed therein, a plurality of flanges depending a predetermined distance from the cover, each flange being disposed surrounding relationship with one of the receptacles, the receptacles being arranged so that when the cover is attached to the body each of the receptacles communicates with one of the cavities and each flange is receivable in one of the cavities.

5. The cover of claim 4 having a central region thereon, the center of mass of the central region lying in a predetermined plane with the center of mass of each of the bosses being spaced from the plane containing the center of mass of the central region.

6. The cover of claim 4 further comprising means for locating the cover at a predetermined angular position with respect to the body of the rotor.

7. In a centrifuge rotor of the type having a rotor body with a plurality of cavities therein, the rotor having a reference surface thereon, each cavity being sized to receive a container able to hold a sample of liquid therein, an upper portion of the container having a predetermined configuration associated therewith and projecting above the reference surface, the improvement comprising:

a cover having an upper and a lower surface thereon, the upper surface having an annular ring disposed thereon, an array of receptacles being formed within the annular ring, each receptacle opening toward the lower surface of the cover, each receptacle corresponding in configuration to the shape of the projecting portion of one of the conttainers.

a plurality of flanges depending a predetermined distance from the cover, each flange being disposed in surrounding relationship with one of the receptacles, and means for locating the cover at a predetermined angular position with respect to the body of the rotor such that when the cover is attached to the body of the rotor, each of the receptacles communicates with one of the cavities and each flange is receivable in one of the cavities.

8. The rotor of claim 7 wherein the locating means comprises a projection disposed on the cover and a locating aperture dispose at a predetermined angular position on the body of the rotor.

9. The rotor of claim 8 wherein the annular ring bounds a central region of the cover, the center of mass of the central region lying in a predetermined plane, the center of mass of the annular ring being spaced from the plane containing the center of mass of the central region.

10. The rotor of claim 7 wherein the annular ring bounds a central region of the cover, the center of mass of the central region lying in a predetermined plane, the center of mass of the annular ring being spaced from the plane containing the center of mass of the central region.

11. In a centrifuge rotor of the type having a rotor body with a plurality of cavities therein, the rotor having a reference surface thereon, each cavity being sized to receive a container able to hold a sample of liquid therein, an upper portion of the container having a predetermined configuration associated therewith and projecting above the reference surface, the improvement comprising:

a cover having an upper and a lower surface thereon, the upper surface having a plurality of bosses disposed in an annular array thereon, a receptacle being formed within each of the bosses, each receptacle opening toward the lower surface of the cover, each receptacle corresponding in configuration to the shape of the projecting upper portion of the cantainer.

a plurality of flanges depending a predetermined distance from the cover, each flange being disposed in surrounding relationship with one of the receptacles, and means for locating the cover at a predetermined angular position with respect to the body of the rotor such that, when the cover is attached to the body of the rotor, each of the receptacles communicates with one of the cavities and each flange is receivable in one of the cavities.

12. The rotor of claim 11 wherein the locating means comprises a projection disposed on the cover and a locating aperture disposeed at a predetermined angular position on the body of the rotor.

13. The rotor of claim 12 wherein the annular array of bosses bounds a central region of the cover, the center of mass of the central region lying in a predetermined plane, the center of mass of each of the bosses being spaced from the plane containing the center of mass of the central region.

14. The rotor of claim 11 wherein the annular array of bosses bounds a central region of the cover, the center of mass of the central region lying in a predetermined plane, the center of mass of each of the bosses being spaced from the plane containing the center of mass of the central region.

15. In a centrifuge rotor of the type having a rotor body with a plurality of cavities therein, the rotor having a reference surface thereon, each cavity being sized to receive a container able to hold a sample of liquid therein, the upper portion of the container having a predetermined configuration associated therewith, the improvement comprising:

an insert sized for insertion into one of the cavities, the insert having an upper surface thereon and a receptacle formed therein, the receptacle corresponding in configuration to the shape of the upper portion of the container, a cover having an upper and a lower surface thereon, the upper surface of the insert lying below the reference surface of the rotor body wben the insert in received in the cavity, the cover having an array of pegs on the undersurface thereof, each of the pegs being received in one of the cavities in the rotor, each peg having a lower surface thereon, the upper surface of each inset abutting against the lower surface of one of the pegs, the upper surface of the cover having an annular ring disposed thereon, the annular ring bounding a central region of the cover, the center of mass of the central region lying in a predetermined plane, the center of mass of the annular ring being spaced from the plane containing the center of mass of the central region, the annular ring being responsive to centrifugal force to generate a holding force acting on the insert to hold the insert in the cavity.

16. In a centrifuge rotor of the type having a rotor body with a plurality of cavities therein, the rotor having a reference surface thereon, each cavity being sized to receive a container able to hold a sample of liquid therein, the upper portion of the container having a predetermined configuration associated therewith, the improvement comprising:

an insert sized for insertion into one of the cavities, the insert having an upper surface thereon and a receptacle formed therein, the receptacle corresponding in configuration to the shape of the upper portion of the container, a cover having an upper and a lower surface thereon, the upper surface of the insert lying below the reference surface of the rotor body when the insert in received in the cavity, the cover having an array of pegs on the undersurface thereof, each of the pegs being received in one of the cavities in the rotor, each peg having a lower surface thereon, the upper surface of each inset abutting against the lower surface of one of the pegs, the upper surface of the cover having an annular array of bosses disposed thereon, the annular array bounding a central region of the cover, the center of mass of the central region lying in a predetermined plane, the center of mass of each of the bosses being spaced from the plane containing the center of mass of the central region, the bosses being responsive to centrifugal force to generate a holding force acting on the insert to hold the insert in cavity.

* * * * *